US007473047B2

(12) United States Patent
Biegel

(10) Patent No.: US 7,473,047 B2
(45) Date of Patent: Jan. 6, 2009

(54) APPLICATOR DEVICE

(75) Inventor: Friedrich Biegel, Nürnberg (DE)

(73) Assignee: Schwan-Stabilo Cosmetics GmbH & Co. KG (DE)

( * ) Notice: Subject to any disclaimer, the term of this patent is extended or adjusted under 35 U.S.C. 154(b) by 0 days.

(21) Appl. No.: 11/942,103

(22) Filed: Nov. 19, 2007

(65) Prior Publication Data

US 2008/0118297 A1 May 22, 2008

(30) Foreign Application Priority Data

Nov. 20, 2006 (DE) ..... 20 2006 017 655 U

(51) Int. Cl.
*B43K 7/02* (2006.01)

(52) U.S. Cl. ..... 401/217; 401/209

(58) Field of Classification Search ..... 401/208, 401/209, 216, 217, 218, 119, 206
See application file for complete search history.

(56) References Cited

U.S. PATENT DOCUMENTS

| | | | | |
|---|---|---|---|---|
| 2,444,003 | A | 6/1948 | Chesler | |
| 2,847,975 | A | 8/1958 | Lawton | |
| 3,446,564 | A | 5/1969 | Horie | |
| 4,457,644 | A * | 7/1984 | Yokosuka | 401/216 |
| 4,645,367 | A | 2/1987 | Mutschler et al. | |
| 5,573,340 | A * | 11/1996 | Gueret | 401/126 |
| 6,076,987 | A * | 6/2000 | Sekine et al. | 401/209 |
| 6,503,016 | B2 | 1/2003 | Raps et al. | |
| 6,997,631 | B2 | 2/2006 | Yamada et al. | |
| 7,037,015 | B1 * | 5/2006 | Witz et al. | 401/4 |

FOREIGN PATENT DOCUMENTS

| | | |
|---|---|---|
| DE | 10041246 | 3/2002 |
| EP | 1498045 | 1/2005 |

* cited by examiner

*Primary Examiner*—David J Walczak
(74) *Attorney, Agent, or Firm*—Bachman & LaPointe, P.C.

(57) ABSTRACT

A device for applying a liquid or gel-like product, in particular a cosmetic product, comprising a rotatably supported ball serving as an applicator element, and a storage chamber for the product to be applied on a side of the ball in opposite relationship to an applicator side of the ball for loading the ball on its side in opposite relationship to its applicator side, wherein the storage chamber has a feed opening for the product to be applied. A vent opening is disposed behind the feed opening as viewed from the ball for venting the storage chamber.

7 Claims, 1 Drawing Sheet

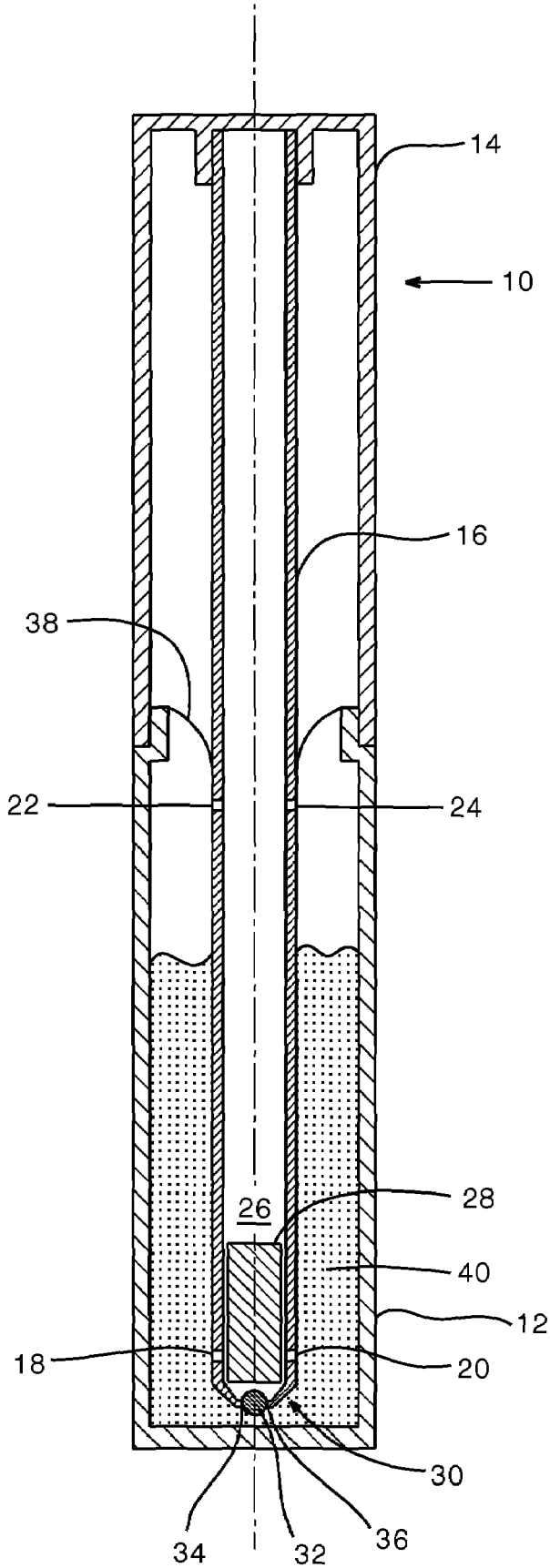
14
10
16
38
22
24
26
28
40
12
18
20
30
34
32
36

APPLICATOR DEVICE

BACKGROUND OF THE INVENTION

The invention concerns a device for applying a liquid or gel-like product comprising a rotatably supported ball serving as an applicator element, and a storage chamber for the product to be applied on a side of the ball in opposite relationship to an applicator side of the ball for loading the ball on its side in opposite relationship to its applicator side, wherein the storage chamber has a feed opening for the product to be applied.

Devices of the above-indicated kind are known in the form of ballpoint pens. In general a predetermined amount of the product is to be applied is stored in the storage chamber of such applicator devices. When the storage chamber is exhausted the ballpoint pen (or at least its refill) has to be thrown away. More specifically refilling is generally at least extremely difficult for a user, if not impossible.

As the user does not usually himself fill the storage chamber with the product he also has no influence for example on the color of the product to be applied. If a different color is wanted a different ballpoint pen or at least a different refill generally has to be employed.

The object of the invention is to provide an applicator device of the kind set forth in the opening part of this specification which does not have to be replaced in the event of the storage chamber being exhausted.

SUMMARY OF THE INVENTION

In accordance with the invention, in the applicator device of the kind set forth in the opening part of this specification, that object is attained by a vent opening which is disposed behind the feed opening as viewed from the ball for venting the storage chamber.

That arrangement provides that, in the event of the storage chamber being exhausted, the storage chamber can be supplied with the product again by being simply dipped into a reservoir for the product to be applied, more specifically simply by the product flowing through the feed opening into the storage chamber, with the vent opening serving for the discharge of air. For that purpose the applicator device is dipped into the product to be applied to such an extent until the feed opening admittedly dips into the product, but the vent opening does not. The product will then flow into the storage chamber in accordance with the law of communicating vessels until the level in the storage chamber corresponds to the level in the reservoir.

The above-described dip system also enjoys the advantage that for example products of different colors can be applied with one and the same applicator device, simply by the desired color being mixed in the reservoir.

The applicator element in ball form, in the fashion of a ballpoint pen, has in particular the advantage of rotational symmetry in dip systems, in comparison with an applicator element in the form of a roller or wheel, as is described for example in EP 1 498 045 A1. That means that, in the operation of applying the product, there is no need to set a predetermined axis of rotation transversely with respect to the direction of application. In addition, a scraper which is possibly provided does not have to be of a geometry which is especially matched to the shape of the applicator element. Rather it can be of a simpler design and can be made from less flexible material.

In comparison with dip systems having an applicator element in the form of a brush or a fiber tip, the applicator element in ball form makes it possible to achieve more uniform and more accurately defined line thicknesses. That is also the case if the contact pressure is to be varied in the application procedure. As the dip systems with brushes and fiber tips in addition usually do not have their own storage means, the line length which can be produced is also considerably greater with the solution according to the invention.

In a preferred feature of the invention a holding device serves for (rotatably) holding the ball.

That once again involves a solution which is known from ballpoint pens.

In that case there is provided at least one passage which is delimited by the holding device on the one hand and the ball on the other hand for the product which is to be applied to pass therethrough on the way from the storage chamber to the applicator side of the ball.

The amount of product applied per length of application line is determined by adjusting the effective cross-sectional area of that passage.

In accordance with a particularly preferred embodiment of the invention the applicator device is elongate and has a hollow space which serves as the storage chamber.

In other words in this configuration the applicator device is of a pen-like form, wherein a (hollow) shaft which is designed rather in the nature of a handle stem served as the storage chamber.

In that case a boundary wall of the hollow space can be formed integrally with the holding device.

In other words this embodiment of the invention provides that the ball is held directly at the working end of the pen or handle stem.

It can however also be provided that the holding device is fixed releasably to the storage chamber. That arrangement means that the holding device (with the ball held thereto) can be replaced as an individual part, for example if different line thicknesses are wanted.

In a particularly preferred embodiment there is provided a device impregnatable with the product to be applied in the storage chamber.

In other words that device provides a buffer storage means of absorbent material within the storage chamber. That improves the storage properties of the overall device.

Besides the applicator device described in detail hereinbefore the invention also provides a cosmetic unit comprising an applicator device of the kind described in detail hereinbefore, and a container for the product to be applied, wherein dipping of the applicator device into the product to be applied which is in the container leads to the product being fed to the storage chamber through the feed opening.

In other words the invention also provides the complete dip system which includes on the one hand the container and on the other hand the applicator device which is to be dipped into the container for filling the storage chamber.

BRIEF DESCRIPTION OF THE DRAWINGS

The invention is described in fuller detail hereinafter by means of a preferred embodiment by way of example with reference to the accompanying drawing in which:

The single FIGURE shows a view in longitudinal section through a cosmetic unit in accordance with a preferred embodiment of the invention.

DETAILED DESCRIPTION

The cosmetic unit shown in the drawing includes an applicator device 10 and a container 12.

The applicator device has a holding portion 14 in which an internally hollow stem 16 fits. The stem has two feed openings 18, 20 and two vent openings 22, 24. The openings 18 through 24 connect an internal space 26 in the stem 16 to the ambient atmosphere around the stem. A puffer storage means 28 of an absorbent material, for example felt, is disposed in the region of the internal space 26, which is the lower region in the drawing.

A working end of the stem 16 or of the applicator device 10 is in the form of a holding device 30 (only diagrammatically shown in the drawing) for a ball 32 which is held freely rotatably by the holding device 30. Two passages 34, 36 are provided between the holding device 30 on the one hand and the ball 32 on the other hand, although this is also only diagrammatically illustrated in the drawing. The passages 34, 36 connect the internal space 26 of the stem 16 to the outside of the ball 32. The two passages 34, 36 represent portions of an annular passage which ensures an uninterrupted line in all directions of the application movement.

Provided on the container 12 is a scraper 38 which is also only diagrammatically illustrated in the drawing. In contrast to those situations which involve the use of applicator elements in the form of a wheel or a roller, that scraper 38 can be of a rotationally symmetrical design and it is also that in this embodiment because the ball 32 is also rotationally symmetrical in contrast to a wheel and a roller which is usually disposed transversely with respect to a longitudinal axis of the container 12.

In the illustrated embodiment liquid red lipstick 40 is contained in the container 12.

The mode of operation of the cosmetic unit illustrated in the drawing is as follows:

The drawing shows a condition shortly after the applicator device 10 is dipped into the container 12. In this condition the stem 16 has displaced product 40, in accordance with its volume. Immediately after the stem 16 is dipped into the product 40 the product will flow into the internal space 28 of the stem 16 through the feed openings 18 and 20. In that situation pressure equalisation takes place through the vent openings 22 and 24. The product 40 which has flowed in through the feed openings 18 and 20 is absorbed by the buffer storage means 28. Product 40 flows through the feed openings 18 and 20 until the level of the product 40 within the internal space 26 corresponds to the level in the container 12 outside the stem 16. In the condition as delivered the level of the product 40 outside the stem 16 is between the feed openings 18, 20 and the vent openings 22, 24.

After that the applicator device is removed from the container 12. The product 40 is then applied by rolling the ball 32—in the case of a lipliner, against the edge of the lips. As in the case of a ballpoint pen, the ball 32 as it rotates transports the product 40 from the internal space 26 through the passages 34 and 36 on to the outside where it is delivered by adhesion to the lips.

The features of the invention disclosed in the foregoing description, the claims and the drawing can be essential for implementing the invention in its various embodiments, both individually and also in any combinations.

The invention claimed is:

1. A cosmetic unit comprising an applicator device for applying a liquid or gel-like product comprising a rotatably supported ball serving as an applicator element, a storage chamber for the product to be applied on a side of the ball in opposite relationship to an applicator side of the ball for loading the ball on its side in opposite relationship to its applicator side, wherein the storage chamber has a feed opening for the product to be applied, and a vent opening disposed behind the feed opening as viewed from the ball for venting the storage chamber, and further comprising:

a container for a product to be applied, wherein dipping of the applicator device into the product in the container leads to the product being fed to the storage chamber through the feed opening.

2. A cosmetic unit as set forth in claim 1 further comprising a holding device for holding the ball.

3. A cosmetic unit as set forth in claim 2 further comprising at least one passage which is delimited by the holding device and the ball for the product which is to be applied, wherein the product passes through the at least one passage on the way from the storage chamber to the applicator side of the ball.

4. A cosmetic unit as set forth in claim 2, wherein the storage chamber comprises an elongated hollow space.

5. A cosmetic unit as set forth in claim 4, further comprising a boundary wall of the hollow space is formed integrally with the holding device.

6. A cosmetic unit as set forth in claim 2, wherein the holding device is fixed releasably to the storage chamber.

7. A cosmetic unit as set forth in claim 1, further comprising a device impregnatable with the product to be applied in the storage chamber.

* * * * *